US005154221A

United States Patent [19]

Vatant et al.

[11] Patent Number: 5,154,221

[45] Date of Patent: Oct. 13, 1992

[54] DEVICE FOR FIXING AND COOLING A GRAPHITE BLOCK OF A GRAPHITE WALL OF A MOULD

[75] Inventors: Robert A. Vatant, Saint-Chamond; Michael F. Courbier, Le Breuil; Luc H. Bertin, Saint-Chamond, all of France

[73] Assignees: Creusot-Loire Industrie, Puteaux; Clecim, Cergy Pontoise, both of France

[21] Appl. No.: 730,879

[22] PCT Filed: Jan. 15, 1990

[86] PCT No.: PCT/FR90/00028

§ 371 Date: Sep. 10, 1991

§ 102(e) Date: Sep. 10, 1991

[87] PCT Pub. No.: WO90/08003

PCT Pub. Date: Jul. 26, 1990

[30] Foreign Application Priority Data

Jan. 16, 1989 [FR] France ..... 8900839

[51] Int. Cl.[5] ..... B22D 18/04; B22D 27/04

[52] U.S. Cl. ..... 164/348; 165/168; 249/80

[58] Field of Search ..... 164/348, 126, 128; 249/79, 80; 165/168, 171

[56] References Cited

U.S. PATENT DOCUMENTS

| | | | |
|---|---|---|---|
| 178,300 | 6/1876 | Jas | 165/168 |
| 1,343,014 | 6/1920 | Troutman | 165/168 X |
| 1,550,185 | 8/1925 | Steenstrup | 165/171 X |
| 2,085,324 | 6/1937 | Lindner | 165/168 X |
| 3,340,926 | 9/1967 | Sylvester | 164/335 X |
| 3,590,904 | 7/1971 | Woodburn Jr. . | |
| 3,986,547 | 10/1976 | Pietryka | 164/348 X |
| 4,669,524 | 6/1987 | Nelson . | |

FOREIGN PATENT DOCUMENTS 1581056 9/1969 France .

*Primary Examiner*—J. Reed Batten, Jr.
*Attorney, Agent, or Firm*—Cushman, Darby & Cushman

[57] ABSTRACT

The graphite wall of a mould for casting a metallurgical product includes a holder frame, a plurality of vertically disposed graphite blocks having vertical bores therein, upper and lower fixing members for fixing each of the graphite blocks in a vertical position on the frame holder. The graphite wall also includes cooling elements for introducing a cooling fluid into the bores. The lower fixing member of each graphite block forms a collector for the cooling fluid.

9 Claims, 5 Drawing Sheets

DEVICE FOR FIXING AND COOLING A GRAPHITE BLOCK OF A GRAPHITE WALL OF A MOULD

Figure 1:
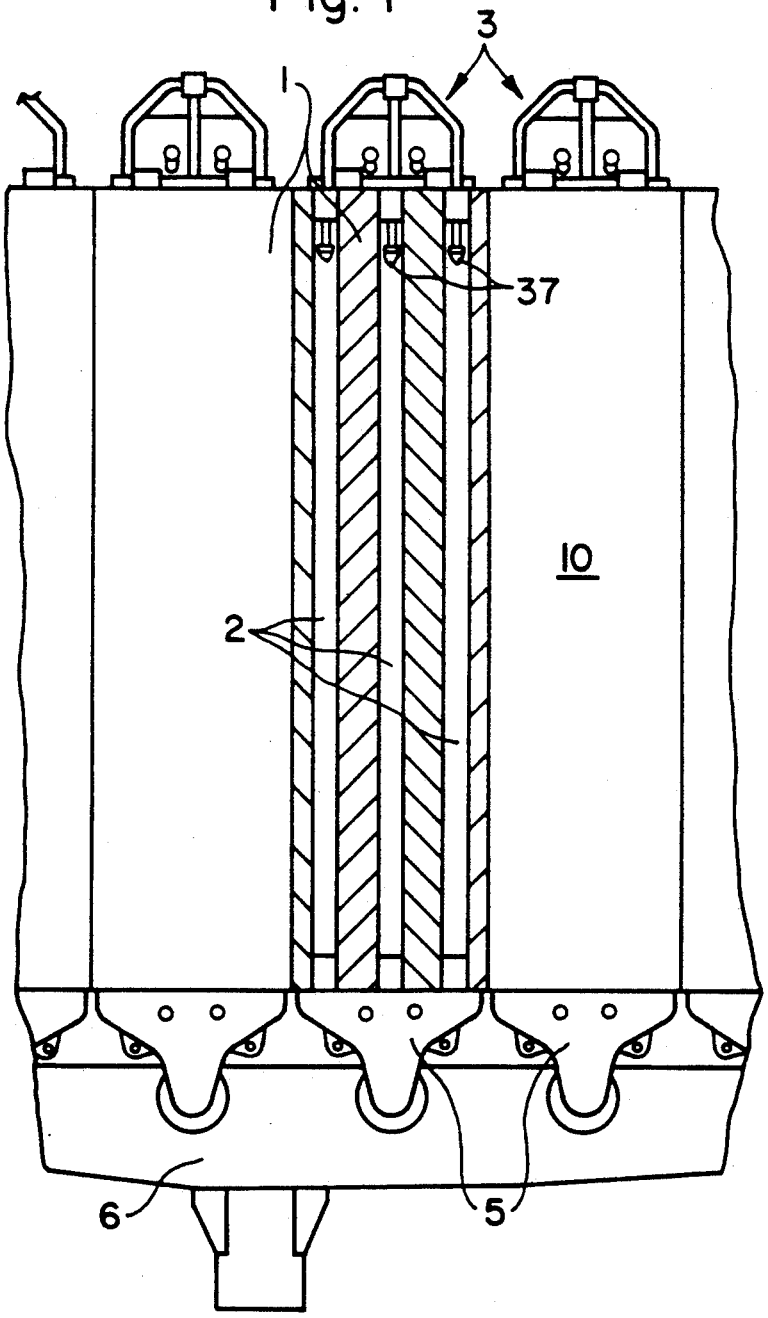

The present invention relates to a device for fixing and cooling a graphite block of a graphite wall of a mould. More particularly, it relates to a device which makes it possible to cool the individual graphite moulding blocks forming the walls of a mould by introducing a sprayed yet of cooling fluid into the spaces provided inside the blocks.

Walls of this type are, in particular, used in moulds for pressure casting metallurgical products such as slabs. These walls are disposed vertically and opposite one another in order to form the large-dimension faces of these moulds, the other faces being formed by the spacers inserted between these walls.

Cooling devices of this type are, in particular, described in the documents FR 1,557,481 and U.S. Pat. No. 3,590,904. In these devices, the graphite blocks comprise vertical bores into which booms or jets for spraying cooling liquid are introduced. A drawback of these devices is that the liquid running over the walls of the bores falls freely into the pit or the trough provided beneath the mould and mixes with the dust and other debris which collect there. This water must therefore be treated and filtered in order to be discharged or reused.

Another drawback lies in the system for holding the graphite blocks which are held on a plate or graphite-holder frame by small fixing plates which are partially inserted into the cooling bores and are bolted onto the frame. Unless these small fixing plates are completely removed in order to take down the graphite blocks, it is impossible to displace the latter relative to one another, for example in order to clean, after a cast, the joining plane between two blocks if metal has infiltrated therein.

Another system for holding the graphite blocks consists in holding them on the frame by means of small fixing plates inserted into a longitudinal groove in the graphite and bolted onto the frame. One of the major drawbacks of these grooves is that it gives rise to a weakening and an incipient break at the top and at the bottom of the graphite blocks, thereby reducing their life span.

The present invention aims to remedy these drawbacks and to facilitate the positioning and the fixing of the graphite blocks on the graphite-holder frame.

Another aim is to provide uniform cooling and to be able to easily adapt the cooling of each one of the blocks.

With these objectives in view, the subject of the present invention is a device for fixing and cooling a graphite block of a graphite wall of a mould, comprising upper and lower means for fixing the said block on a graphite-holder frame and means for introducing a cooling fluid into vertical bores provided in the block.

According to the invention, this device is characterized in that the lower fixing means form a collector for the cooling fluid introduced into the said bores.

By virtue of the invention, the cooling fluid introduced into the bores of the block may easily be collected and channelled, which makes it possible for it to be reused directly without having to be treated. Moreover, as the collector also fixed the mould on the frames, the construction of the mould is thereby facilitated.

According to a particular arrangement of the invention, the collector comprises, at its upper part, a longitudinal horizontal groove, parallel to the surface of the wall of the mould, this groove receiving a slide or lower thin strip provided with tubular elements inserted into the bores in the graphite block, at the lower end of the latter.

The tubular elements emerge opposite entry orifices in the collector. Contact between the lower thin strip and the collector provides a seal in order to prevent leakages of cooling fluid underneath the graphite block.

The lower thin strip can slide longitudinally in the groove of the collector which, on the one hand, facilitates the positioning of the block relative to the frame insofar as the alignment between the bores in the block and the entry orifices in the collector does not have to be performed with great precision and, on the other hand, makes it possible, without removing the block, to make it slide slightly in order, for example, to clean the interface between two adjacent blocks and, above all, to provide the freedom necessary to ensure the longitudinal clamping of the blocks or their expansion.

Other characteristics and advantages will emerge from the description which will be given by way of example of a device according to the invention.

Figure 2:
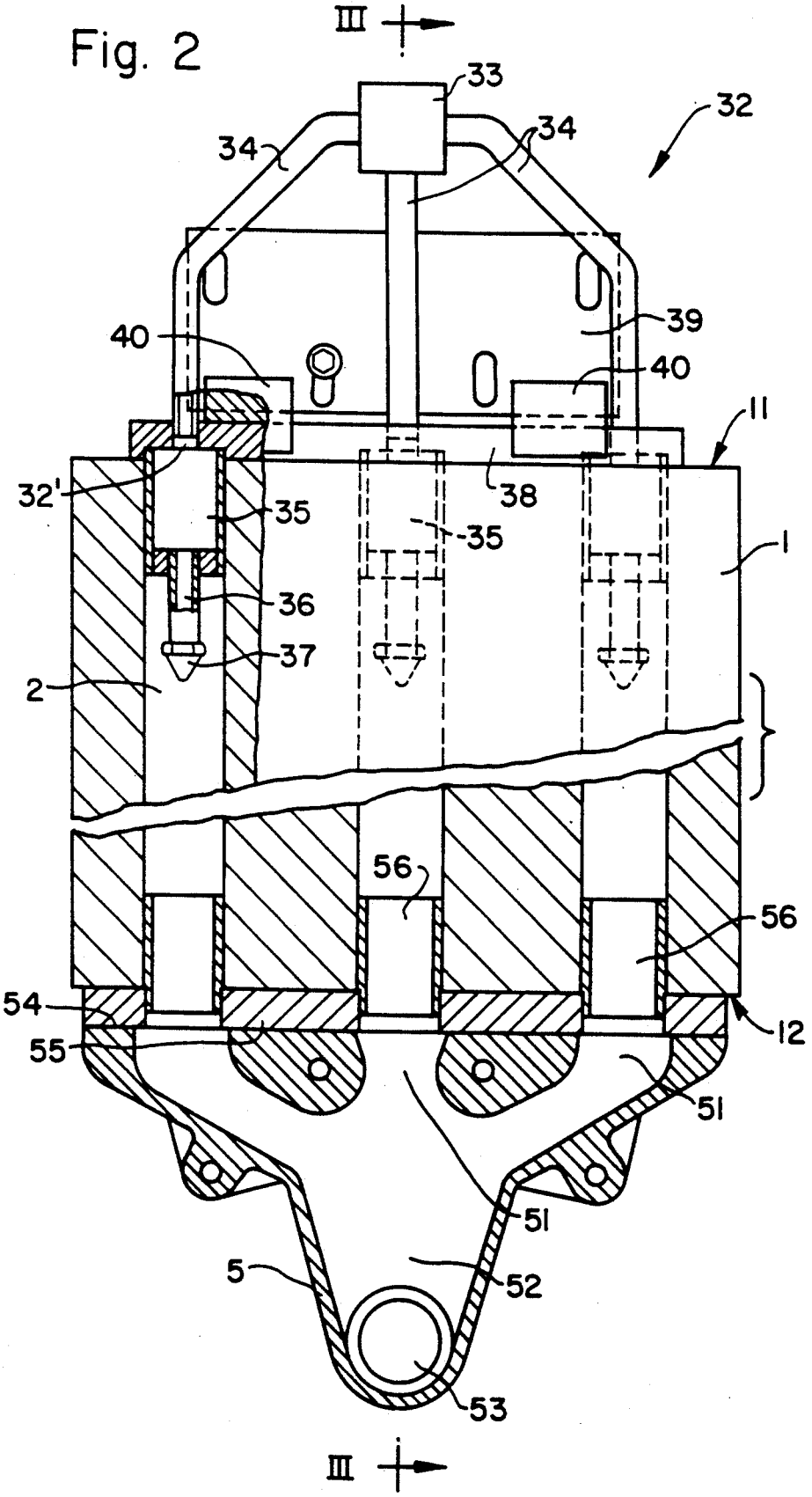
Figure 3:
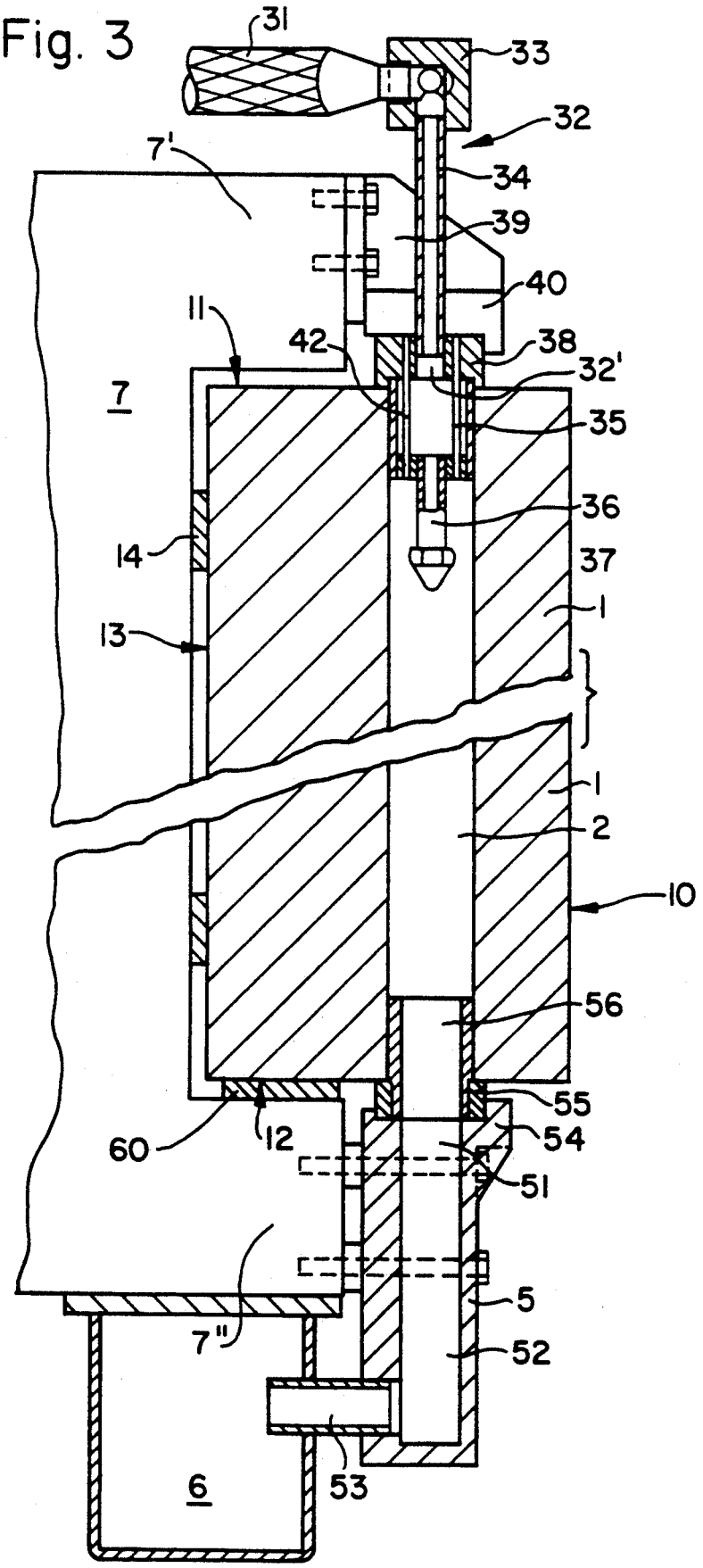
Figure 4:
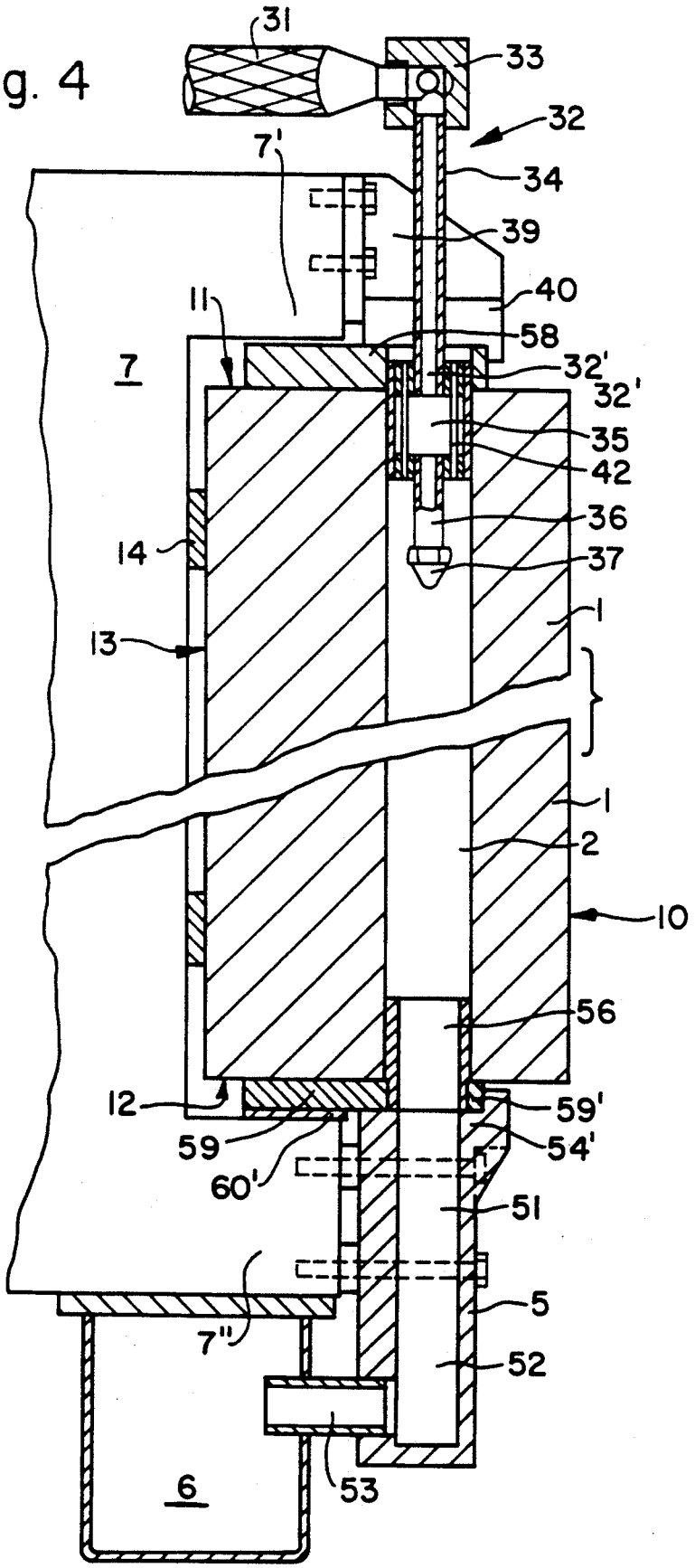
Figure 5:
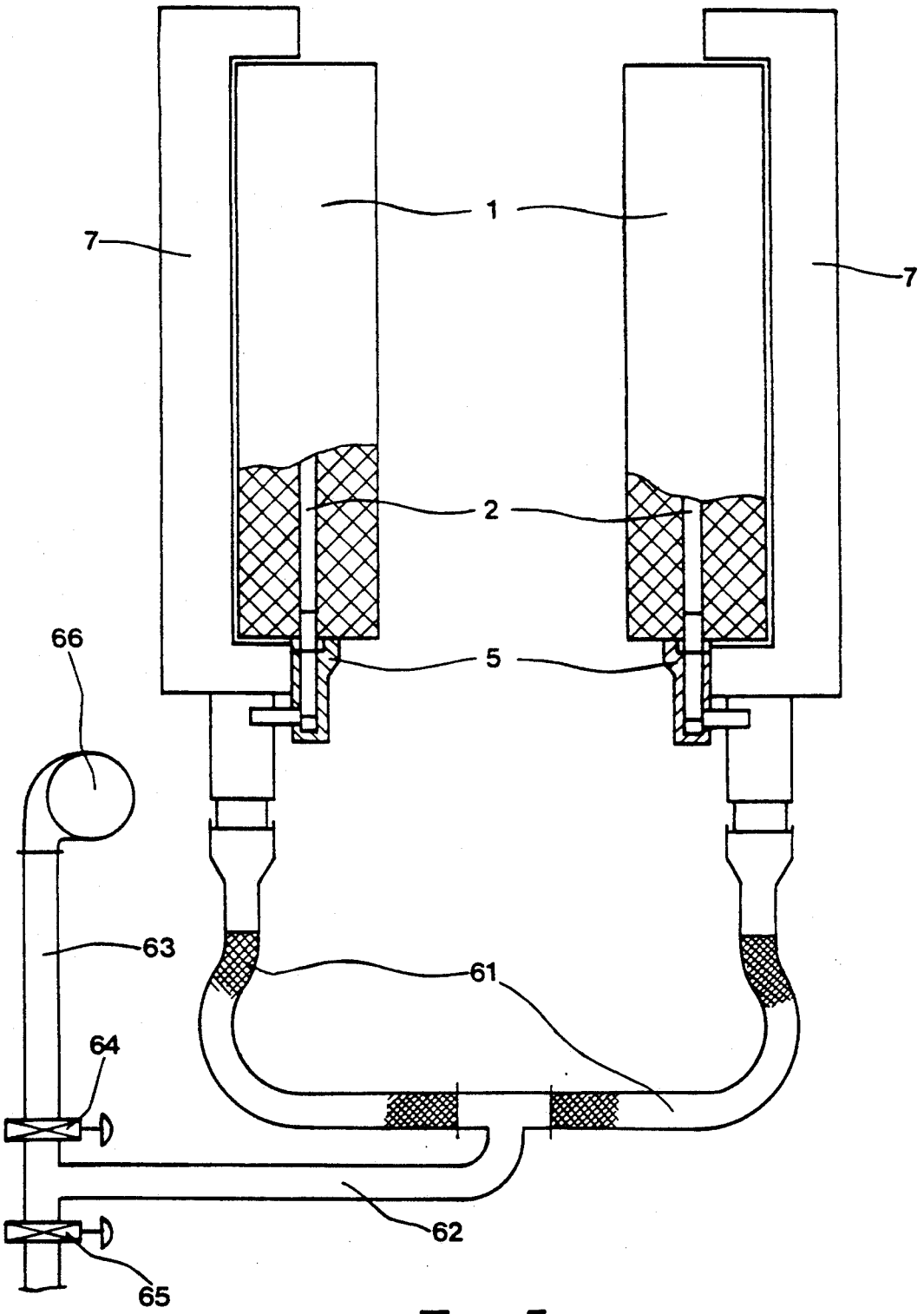

Reference will be made to the appended drawings, in which:

FIG. 1 is a partial front view of one of the large-dimension graphite walls of a pressure-casting mould, FIG. 2 is a detailed view of a graphite block and of its fixing and cooling means, FIG. 3 is a sectional view of the graphite block along the line III-III in FIG. 2, FIG. 4 is a similar view showing an alternative embodiment of the fixing means, FIG. 5 is a simplified view of an alternative embodiment of the means for recovering water, permitting the occasional injection of compressed air into the bores in the graphite blocks.

FIG. 1 shows part of the vertically disposed wall of a mould for pressure casting metallurgical products, in particular steel slabs. A mould of this type comprises two of these walls opposite one another and forming the large-dimension walls of the mould, the other walls being formed by spacers, not shown, inserted between the large walls so as to form a volume of parallelepipedal form in which the molten metal is introduced under pressure via an orifice provided between the lower spacer, the front spacer and the two lateral walls.

The wall consists of a plurality of graphite blocks 1 assembled contiguously in order to form a plane surface 10 inside the mould.

The graphite blocks comprise vertical bores 2 located in the same vertical plane parallel to the surface 10 of the wall. These bores may optionally comprise a stainless-steel sleeve at their upper or lower parts in order to protect the graphite, the upper sleeve having a sufficient length which is chosen in order to minimise the effects of the direct cooling of the graphite by spraying in the upper zone of the blocks.

At their upper part, the blocks comprise means 3 for feeding a cooling fluid, usually water. The sprayed water runs over the inner walls of the bores and, by means of gravity, flows towards the lower end of the latter where it is collected by the collectors 5. Each collector is connected to a single graphite block and comprises an exit orifice 53 emerging into a trough 6 which, in turn, collects the water coming from the various collectors associated with each block, respectively.

These various elements are shown in more detail in the drawings of FIGS. 2 and 3. All the blocks of a wall are fixed on the same graphite-holder frame 7. This frame has a C-shaped cross-section, in which the graphite blocks partially penetrate, play being provided between the upper faces 11 of the blocks and the upper extension part 7' of the frame, which forms the upper branch of the C.

The graphite block rests on the lower extension part 7'' of the frame, which forms the lower branch of the C, by means of a wedge 60 made from thermally insulating material.

The means for feeding cooling water comprise a feed hose 31 connected to a distributor 32 whose exits 32' are connected to the upper ends of the bores 2. The distributor 32 consists of a distribution box 33 provided with tubes 34 whose exit ends emerge opposite the bores 2 in hollow cylindrical elements 35 to which they are connected in a leaktight manner. The cylindrical elements 35 have an external diameter which is equal to that of the bores and they are partially inserted in the latter at their upper ends. Joining tubes 36, which carry spraying nozzles 37, are also fixed in a leaktight manner to the lower part of these cylindrical elements.

The hollow cylindrical elements 35 may also comprise through vent tubes 42 which enable the vapour produced by the cooling by spraying to escape.

As these hollow cylindrical elements 35 have an internal diameter which is markedly greater than that of the joining tubes, they form individual buffer reservoirs or tanks for the cooling water feeding each bore. This makes it possible to limit the effects, on the flow of water sprayed by the nozzles, of possible variations in the feed pressure and, consequently, the variations in flow and thus of cooling between the various blocks of the wall and also between the bores of the same block.

This arrangement also makes it possible easily to modify the penetration depth of the nozzles in the bores by merely changing the joining tube 36 between the cylindrical element 35 and the nozzle 37, which, in particular, makes it possible to define preferential cooling zones with a height which is chosen as a function of the height of the slab cast.

The upper parts of the cylindrical elements 35 which extend above the upper surface of the block are fixed on an upper thin strip 38 which holds them in position relative to one another. One or more clips 39 are placed so as to bear on the thin strip 38 and are screwed onto the frame 7 in order to hold the thin strip and therefore the block 1 at its upper part. In order to prevent the block 1 moving towards the frame, in particular through the action of ferrostatic pressure during casting, wedges 14 are inserted between the rear face 13 of the block and the frame. The thickness of these wedges is adjusted as a function of the distance separating the rear face 13 from the bores 2.

Longitudinal play is provided between the extension parts 40 of the clip 39 and the water-feed tubes 34 so as to permit slight displacement of the water-feed means 3 and thus of the block to which they are attached relative to the clip 39 which is fixed in position relative to the frame.

The collector 5 is fixed by screws to the frame 7. It comprises entry orifices 51 which emerge in an inner chamber 52 of the collector, the lower part of which comprises an exit orifice 53 which emerges into the recovery trough 6 located beneath the graphite-holder frame 7.

At its upper part, the collector comprises a groove 54 which receives, with the possibility of longitudinal displacement therein, parallel to the inner surface 10 of the wall of the mould, a lower thin strip 55. The lower thin strip 55 is provided with tubular elements 56 inserted in the bores 2 in the block 1 at the lower end of the latter, opposite the entry orifices 51 of the collector.

The collector 5 is pressed in a leaktight manner beneath the lower thin strip 55.

By virtue of the groove 54, in which the lower thin strip 55 can slide, it is possible to displace the block 1 longitudinally relative to the collector 5 and thus relative to the graphite-holder frame 7.

As will already have been understood, the device according to the invention for fixing graphite blocks on a frame in order to form the large-dimension walls of a mould thus permits a certain latitude in the longitudinal positioning of the blocks, which results from the slight permitted offsetting, on the one hand between the graphite block and the collector which acts as its support and lower fixing and, on the other hand, between the block and the water-feed means which are connected thereto and the fixed clip providing its upper fixing. The offsetting at the level of the upper fixings is, moreover, permitted by the flexible join afforded by the flexible feed hose 31. Of course, this offsetting of the block must be sufficiently small for the entry orifices of the collector to remain at least largely opposite the bores in the block.

Moreover, by simply unclamping the collectors 5 and the clips 39 it is possible to cause the graphite blocks to slide relative to one another in order to permit, as already indicated, cleaning of the space between two blocks without it being necessary to take down the latter.

In the alternative embodiment shown in FIG. 4, only certain elements of the means for fixing the block 1 on the frame 7 are modified. In this alternative embodiment, the thin strip 38 is replaced by an upper bearing plate 58 which has a greater width than the thin strip 38 in the direction perpendicular to the face 10 of the block, which extends towards the rear face 13 of the said block in order to engage beneath the upper extension part 7' of this frame. This upper bearing plate is inserted, with play, between the upper face 11 of the block and the lower face of the extension part 7'. The plate is held by the clip 39 in the same manner as in the first alternative embodiment.

At the lower part of the block, the lower thin strip 55 is replaced by a lower bearing plate 59, similar to the upper bearing plate 58, which is inserted between the lower face 12 of the block and the upper face of the lower extension part 7'' of the frame 7. The groove 54 of the collector 5, in its first alternative embodiment shown in FIG. 3, is dispensed with here and the collector comprises a longitudinal bead 54' which is applied on the edge 59' of the lower bearing plate 59 which is most distant from the frame 7 in order to hold the lower part of the block 1 pressed against the frame. The collector 5 thus performs the same function of holding the block 1 at its lower part as the clip 39 does in respect of its upper part.

A sheet 60' of thermally insulating material is placed between the lower bearing plate 59 and the upper face of the lower extension part 7'' of the frame in order to prevent the frame heating up by means of conduction via the graphite block and the lower bearing plate 59.

In this alternative embodiment, the embedding in the graphite of the hollow cylindrical elements 35 and of the tubular elements 56 combined with the plates 58, 59 is better effected since, at the upper part, the plate 58 is wider and held horizontally and, above all, at the lower part, because the plate 59 is held firmly by the actual weight of the graphite block. Thus, the risk of damage to the graphite at the level of the contact surface between the plates 58, 59 and the graphite block 1 is reduced.

In the alternative embodiment shown in FIG. 5, the recovery troughs 6 fixed beneath the graphite-holder frame 7 are connected via hoses 61 to a first pipe 62 emerging in a second pipe 63 between two valves which make it possible to close off this second pipe. When the upper valve 64 is closed and the lower valve 65 is open, the water collected by the troughs 6 flow via the hoses 61, the pipe 62 and the lower valve 65 in order to be discharged or recovered for recycling.

By closing the lower valve 65 and by opening the upper valve 64, air, supplied by blowing means such as a fan 66 connected to the second pipe 63 upstream of the upper valve 64, may be blown into the circuit and thus into the bores 2 in the graphite blocks, this air being able to escape at the upper part of the bores, for example via the vent tubes 42.

One of the additional advantages of the arrangement of the leaktight recovery circuit which has just been described is thus that it permits the occasional air pressurization of the bores 2 in the graphite blocks and thus prevents the pollution of the circuits and of the water during the operations of cleaning and of coating the graphite blocks performed before each cast.

The invention is not limited to the device which has just been described by way of example. Although the device according to the invention is particularly advantageous for the fixing and the cooling of the graphite blocks forming the large-dimension walls of a pressure-casting mould, it may be applied generally to cooled walls of other moulds, it being possible for the blocks forming these walls to be made from materials other than graphite.

We claim:

1. A graphite wall of a mould for casting a metallurgical product comprising:

a holder frame, a plurality of vertically disposed graphite blocks having vertical bores therein, upper and lower fixing members for fixing each of said graphite blocks in a vertical position on said holder frame, and means for cooling said graphite blocks including means for introducing a cooling fluid into said vertical bores, said lower fixing member of each graphite block forming a collector for said cooling fluid.

2. A graphite wall of a mould according to claim 1, wherein said collector includes entry orifices being connected to said bores in a leak tight manner, and exit orifices for removing said cooling fluid from said collector.

3. A graphite wall of a mould according to claim 1, wherein said collector includes a longitudinal groove, a thin strip member being disposed in said groove, said strip member including plurality of tubular elements disposed in said bores of said graphite blocks.

4. A graphite wall of a mould according to claim 1, wherein said means for introducing a cooling fluid is a cooling-fluid distributor disposed above said blocks, said distributor including exit ports connected to upper ends of said bores.

5. A graphite wall of a mould according to claim 4, wherein said distributor includes an upper thin strip member disposed at a lower portion of said distributor, said upper thin strip member having hollow cylindrical elements which penetrate into said bores.

6. A graphite wall of a mould according to claim 5, wherein said upper fixing member includes clips bearing on said upper thin strip member and affixed to said frame, longitudinal play being provided between said clips and said distributor.

7. A graphite wall of a mould according to claim 5, wherein said hollow cylindrical elements include joining tubes disposed at lower ends thereof, said joining tubes having spraying nozzles.

8. A graphite wall of a mould according to claim 5, wherein said hollow cylindrical elements include vent tubes.

9. A graphite wall of a mould according to claim 1, further including means for blowing air into said bores, said blowing means being leak tightly connected to said collector.

* * * * *